US011241091B2

(12) United States Patent
Salice

(10) Patent No.: US 11,241,091 B2
(45) Date of Patent: Feb. 8, 2022

(54) PULL-OUT GUIDE FOR DRAWERS OR THE LIKE

(71) Applicant: ARTURO SALICE S.P.A., Novedrate (IT)

(72) Inventor: Sergio Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 16/762,989

(22) PCT Filed: Nov. 13, 2018

(86) PCT No.: PCT/EP2018/081034
§ 371 (c)(1),
(2) Date: May 11, 2020

(87) PCT Pub. No.: WO2019/096769
PCT Pub. Date: May 23, 2019

(65) Prior Publication Data

US 2020/0275777 A1 Sep. 3, 2020

(30) Foreign Application Priority Data

Nov. 20, 2017 (IT) ..... 102017000132137

(51) Int. Cl.
*A47B 88/49* (2017.01)
*A47B 88/45* (2017.01)

(52) U.S. Cl.
CPC ..... *A47B 88/49* (2017.01); *A47B 88/45* (2017.01)

(58) Field of Classification Search
CPC ..... A47B 88/40; A47B 88/45; A47B 88/49
(Continued)

(56) References Cited

U.S. PATENT DOCUMENTS 3,857,618 A * 12/1974 Hagen ..... F16C 33/306 384/18
5,765,736 A * 6/1998 Fischer ..... B60N 3/102 224/281
2017/0184151 A1 6/2017 Huang

FOREIGN PATENT DOCUMENTS

DE 20 2004 006284 U1 5/2005
DE 20 2006 012088 U1 12/2007
(Continued)

OTHER PUBLICATIONS

International Search Report and Written Opinion dated Jan. 21, 2019 issued in PCT/EP2018/081034.
(Continued)

*Primary Examiner* — James O Hansen
(74) *Attorney, Agent, or Firm* — Scully, Scott, Murphy & Presser, P.C.

(57) ABSTRACT

A pull-out guide for drawers or the like comprising a fixed guide part fastenable to the body of a piece of furniture, a movable guide part fixable to a drawer or the like, an intermediate guide part between the fixed guide part and the movable guide part, wherein at least one first sliding carriage is interposed between the fixed guide part and the intermediate guide part and at least one second carriage is interposed between the movable guide part and the intermediate guide part; means of synchronizing the pull-out guide is further provided which comprise at least one synchronization element arranged on the intermediate guide part and contoured to functionally connect the fixed guide part and the movable guide part to each other during the pull-out or retraction movement of the pull-out guide.

12 Claims, 5 Drawing Sheets

(58) Field of Classification Search
USPC ..... 312/331, 334.1, 334.8
See application file for complete search history.

(56) References Cited

FOREIGN PATENT DOCUMENTS

| | | | |
|---|---|---|---|
| WO | WO 2009/036882 | A2 | 3/2009 |
| WO | WO 2011/103605 | A1 | 9/2011 |

OTHER PUBLICATIONS

Italian Search Report dated Jun. 11, 2018 issued in IT 201700132137, with partial translation.

* cited by examiner

PULL-OUT GUIDE FOR DRAWERS OR THE LIKE

The present invention relates to a pull-out guide for drawers or the like, in particular of the full pull-out type, comprising an intermediate guide part which is arranged between a fixed guide part that can be fastened to the body of a piece of furniture and a movable guide part which can be fixed to a drawer or the like and can be moved with respect to them by means of sliding carriages.

It is known to use full pull-out guides for drawers, which comprise a fixed guide parts that can be anchored to the body of a piece of furniture, a movable guide part which can be fixed to a drawer or the like, and an intermediate guide part which is arranged between them, and can move with respect to each other by means of carriages provided with rolling sliding elements, which are interposed between said parts of the guide and are capable of moving along the guide parts between appropriate stops.

Except for specific constructive requirements, during the extraction or retraction movement of the guides, ideally the movement of the intermediate guide with respect to the fixed guide should be substantially equal to the movement of the movable guide with respect to the intermediate guide; furthermore, the sliding carriages should move along the guiding parts with a mutual movement of equal extent with respect to the intermediate guide part.

However, due to unwanted sliding of the carriages along the guides, which can occur in particular when the drawer is loaded with considerable weight, the relative positions between the guide parts and the carriages may be incorrect, seriously contrasting the movement of the drawer and in an extreme case preventing the correct closure of said drawer by the closure devices conventionally provided by the guides.

Furthermore, if the relative positions of the guide parts have not been corrected during the opening/closing movement of the guides, excessive stresses can be generated on said guide parts and can lead to a considerable lowering of the drawer, particularly in the fully extracted position.

In order to avoid or reduce the problems cited above, the use of appropriate means for synchronization or coordination of the mutual movements of the guide parts and/or of the carriages has been variously proposed.

For example, EP 2 187 780 proposes synchronization means in the form of a gear which is supported by the intermediate guide part so as to engage racks provided on the sliding carriages. However, these synchronization means do not allow to reliably control the placement of the guide parts and furthermore entail a greater constructive and assembly complexity of the guides, since for each length size of the guides it is necessary to provide correspondingly sliding carriages of different lengths between the movable guide part and the intermediate guide part.

Another solution that has been proposed to overcome at least partly these drawbacks, known for example from EP 2 538 818, consists in providing synchronization means which comprise a double gear supported by the intermediate guide part and capable of engaging on one side a rack provided inside the movable guide part and on the other side a rack provided on the sliding carriage between the fixed guide part and the intermediate part.

However, such a solution still has drawbacks: in particular, it is constructively complex to fasten the rack inside the movable guide part and in any case the correct mutual positioning of the guide parts is not assured.

The aim of the present invention is to provide a pull-out guide for drawers or the like that allows to achieve optimum support and better distribution of the loads on the parts of the guide and therefore lower stresses on said parts and a reduced lowering of the drawer in the fully extracted position.

Within this aim, an object of the present invention is to provide a pull-out guide of the kind being considered, provided with motion synchronization means that entail reduced modifications with respect to non-synchronized guides it and ensure reliable and silent operation thereof.

This aim, as well as this and other objects which will become better apparent hereinafter, are achieved by a pull-out guide for drawers or the like, comprising a fixed guide part fastenable to the body of a piece of furniture, a movable guide part fixable to a drawer or the like, an intermediate guide part between said fixed guide part and said movable guide part, at least one first sliding carriage interposed between the fixed guide part and the intermediate guide part, at least one second carriage interposed between the movable guide part and the intermediate guide part, and means of synchronizing the pull-out guide, characterized in that said synchronization means comprise at least one synchronization element arranged on said intermediate guide part and contoured to functionally connect said fixed guide part and said movable guide part to each other during the pull-out or retraction movement of the pull-out guide.

Further characteristics and advantages of the present invention are furthermore defined in the claims that follow.

The characteristics and advantages of the present invention will become better apparent from the following description of some preferential but not exclusive embodiments of the pull-out guide for drawers or the like, with reference to the accompanying figures, wherein.

Figure 1:
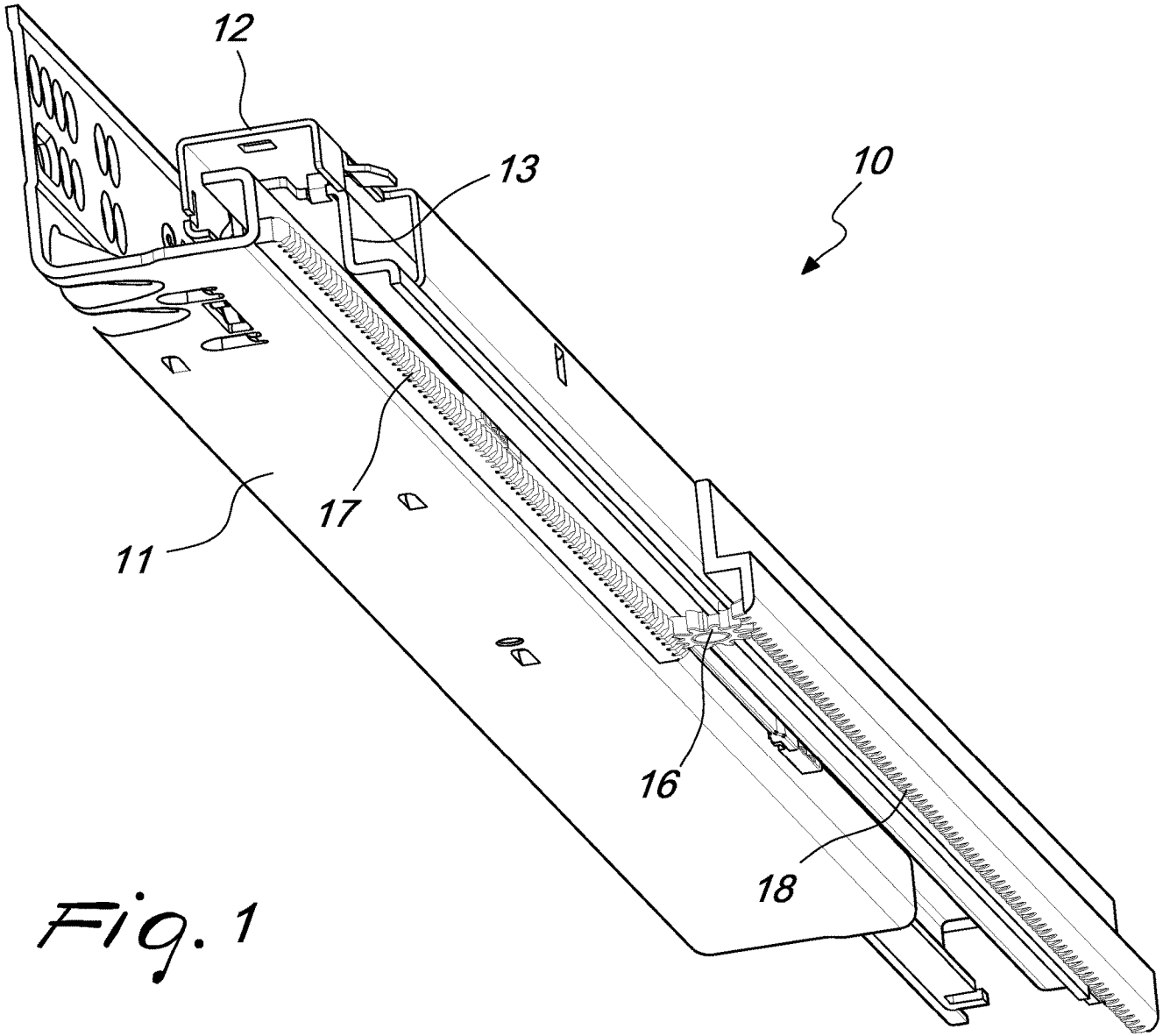
FIG. 1 is a bottom perspective view of the pull-out guide according to a first embodiment of the present invention.
Figure 2:
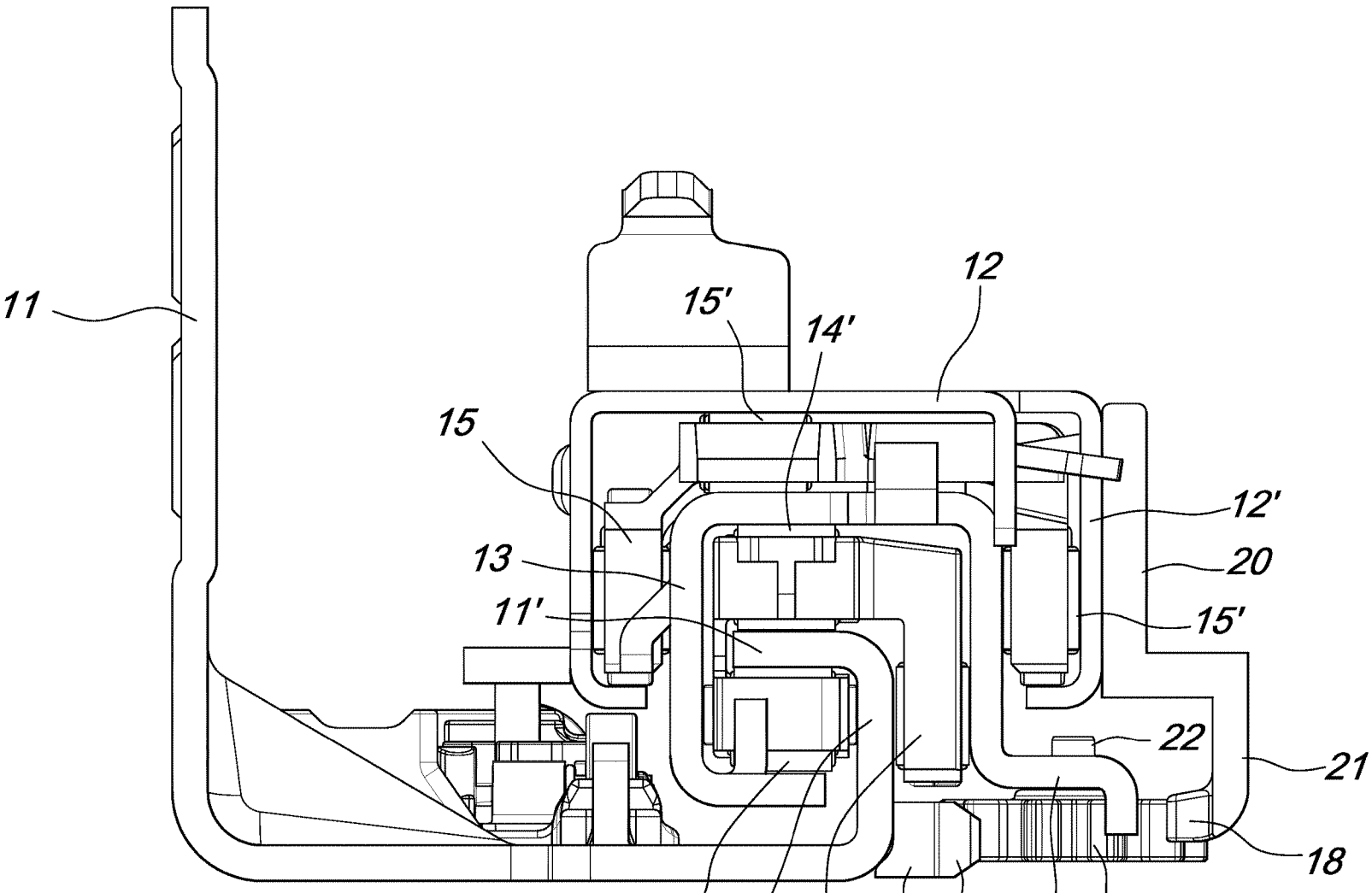
FIG. 2 is a front view of the pull-out guide of FIG. 1.

FIGS. 1 and 2 show a pull-out guide for drawers and the like according to a first preferential embodiment of the present invention, generally designated by the reference numeral 10, which comprises a fixed guide part 11, which can be fastened to the body of a piece of furniture, a movable guide part 12, which can be fixed to a drawer or the like, and an intermediate guide part 13 between the fixed part 11 and the movable guide part 12. Between the fixed guide part 11 and the intermediate guide part 13 there is at least one first carriage 14 provided with rolling elements 14', for example in the form of rollers, for the sliding of the guide parts 11, 13, while between the intermediate guide part 13 and the movable guide part 12 there is a second carriage 15 provided with rolling elements 15' for the sliding of the guide parts 13, 12.

Guide synchronization means are furthermore provided which, according to the present invention, comprise at least one synchronization element 16 arranged on the intermediate guide part 13 and contoured to functionally connect to each other the fixed guide part 11 and the movable guide part 12 during the extraction or retraction movement of the pull-out guide 10.

In this guide construction, the first sliding carriage 14 is interposed between a bent end section 11' of the fixed guide part 11 and the intermediate guide part 13; furthermore, the movable guide part 12 has a zo partially closed section, for example shaped like an inverted U, such as to enclose and surmount at least partially the intermediate guide part 13 and the bent section 11' of the fixed guide part 11.

The at least one synchronization element 16 interacts with respective engagement sections 17, 18 on the fixed guide part 11 and the movable guide part 12, in which the engagement sections 17, 18 are extended so as to be mutually opposite at least along one longitudinal portion of said guide parts 11, 12.

The engagement sections 17, 18 are preferably in the form of racks, while the synchronization element 16 is in the form of at least one pinion that is supported rotatably on the intermediate guide part 13 and is interposed between the racks 17, 18.

For the purpose of assembly simplification and in order to allow optionally later fitting of the retrofit type to conventional non-synchronized guides, preferentially the engagement sections 17, 18 are formed on separate support elements 19, 20 which are applied to the fixed and movable guide parts 11, 12.

In particular, there is preferably a first support element 19 in the form for example of a strip or elongated element applied to a side wall 11" of the bent section 11' of the fixed guide part 11, said element being provided laterally with the rack 17, which is extended longitudinally starting from the front end of the fixed guide part 11 for at least one portion of its extension.

The elongated element 19 can be made of plastic material or other suitable material and can be fixed for example by providing pins or lugs that protrude from said element in order to be inserted in adapted holes in the side wall 11" and finally riveted, or by way of screwed fixing elements or by way of snap-acting fixing means in order to allow also retrofit application.

There is preferably also a second support element 20 in the form for example of an elongated and appropriately shaped strip or plate, which is applied to a side wall 12' of the movable guide part 12, said element having the corresponding rack 18, and is extended longitudinally starting from the rear end of the movable guide part 12 for at least one portion of its extension.

The support element 20 can be made of plastic material or other suitable material and can be fixed for example by providing studded holes in the side wall 12' of the movable guide part 12 in which to insert fixing screws or pins or dowels which are separate or belong to said element to be locked by riveting, or by means of snap-acting fixing means in order to also allow retrofit application.

In order to arrange the engagement sections 17, 18 mutually opposite, at least one of the support elements, for example the support element 20, has an extension 21 on which the corresponding engagement section 18 is formed and protrudes downward in order to arrange the engagement section 18 in front and facing the other engagement section 17 on the first support element 19.

In the case shown in FIGS. 1 and 2, the synchronization pinion 16 is supported so that it can rotate about a vertical axis, for example supported by a pivot 22 which is fixed, for example by riveting, to a lateral band 13' of the intermediate guide part 13 which is extended horizontally along said guide part 13.

It is not excluded, in any case, that other arrangements of the rotation axis of the synchronization pinion are possible, for example a horizontal or slanting one, and consequently other arrangements of the engagement sections are also possible.

Figure 3:
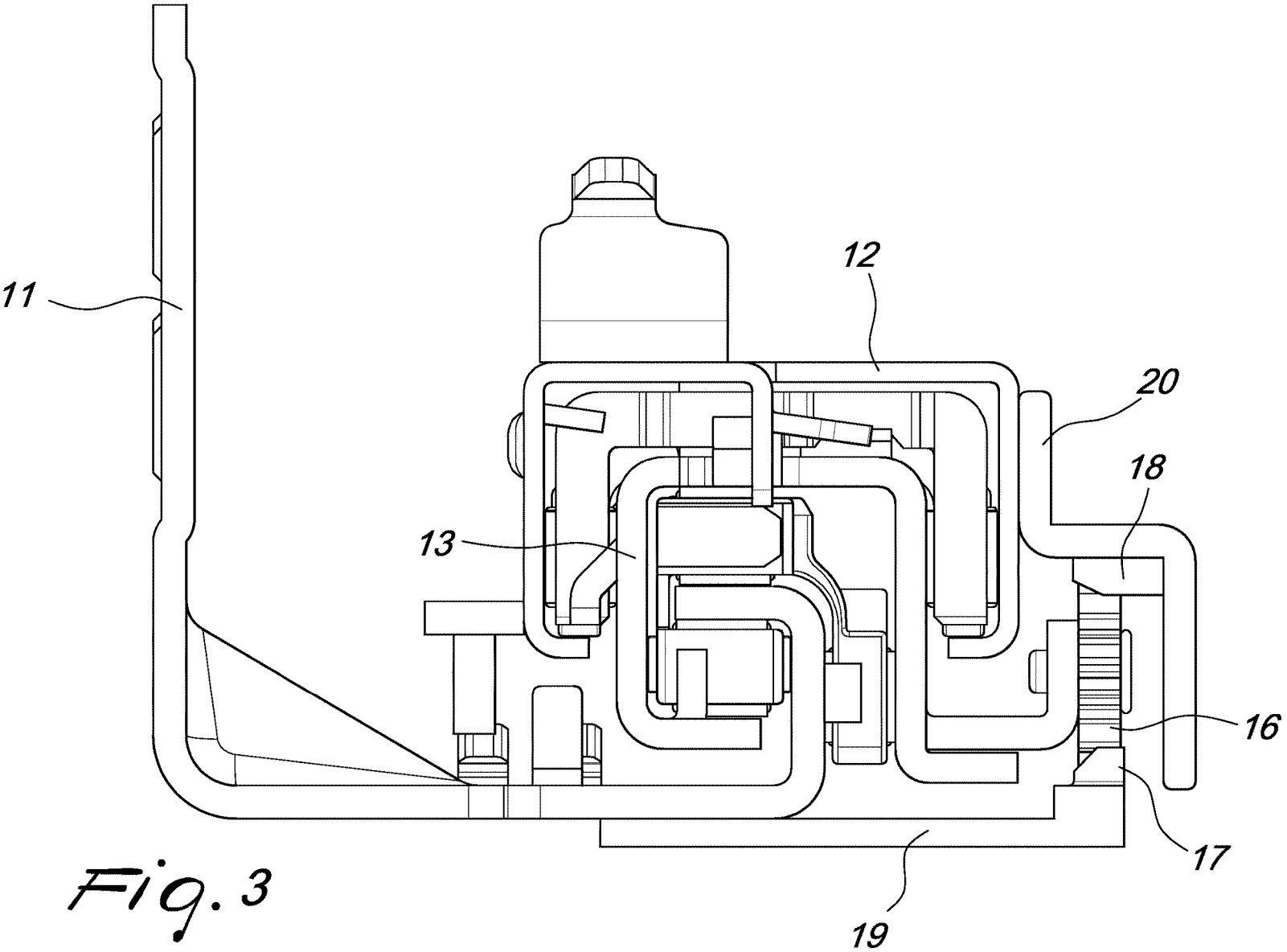
FIG. 3 is a front view of the pull-out guide according to a variation of the embodiment of FIG. 1.

For example, FIG. 3 shows a variation of the pull-out guide according to the present invention, in which the pinion 16 is supported so that it can rotate by the intermediate guide part 13 along a horizontal axis, in which the first rack 17 is directed upward and supported by a first support element 19, for example in the form of a laterally and longitudinally elongated plate, and in which the second rack 18 is directed downward and is supported by a second support element 20, for example in the form of a suitably contoured plate, which is extended longitudinally and is fixed to one side of the movable guide part 12.

Going back to the embodiment of FIGS. 1 and 2, preferentially the extension 21 of the support element 20 has an appropriate contoured cross-section or a specific shape so that it yields elastically in a controlled manner in a direction that is perpendicular to the rotation axis of the synchronization element 16; in this manner it is possible to compensate for any oscillations of the movable guide parts 12 along their longitudinal axis and to selectively disengage the synchronization element 16 from the engagement section 18 provided on the extension 21, the latter being a situation that may become necessary in extreme cases when the guide parts have become mutually offset, for example due to inappropriate transport or assembly conditions of the guide.

As an alternative it is in any case possible to provide other forms of controlled elastic yielding of the engagement sections and/or of the synchronization element.

Figure 5:
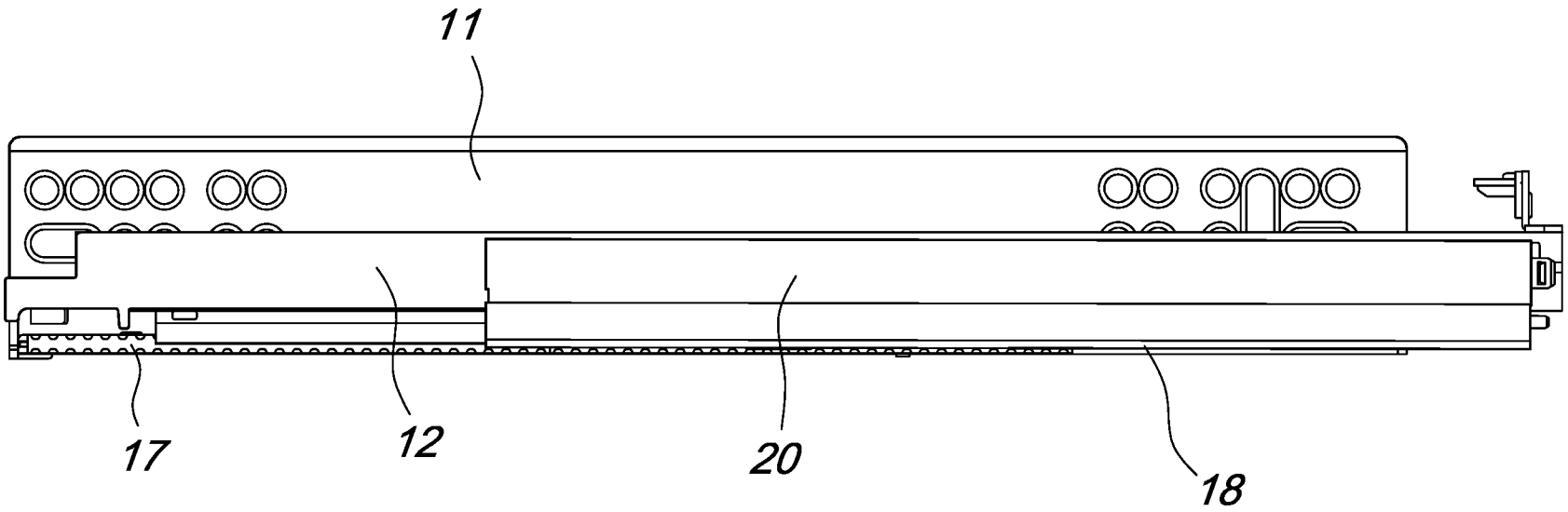
FIG. 5 is a side view of the pull-out guide according to an embodiment of the pull-out guide of FIG. 1.

The engagement section 18 provided on the movable guide part 12 can be arranged so as to be extended along an axis that is parallel to the longitudinal axis of the movable guide part 12 or, as shown in FIG. 5, the engagement section 18 provided on the movable guide part 12 can be arranged so as to be extended along an axis that is inclined with respect to said longitudinal axis on a vertical plane, so as to be able to compensate for any lowering or oscillation of the movable guide part 12 with respect to the other guide parts with the loaded drawer in the open position.

The engagement section 18 provided on the movable guide part 12 can be arranged so as to be extended along an axis that is parallel to the longitudinal axis of the movable guide part 12 or can be extended along an axis that is inclined with respect to said longitudinal axis on a vertical plane, so as to be able to compensate for any lowering or oscillation of the movable guide part 12 with respect to the other guide parts with the loaded drawer in the open position.

In the case shown in FIGS. 1 and 2, there is a single synchronization element 16 which defines a transmission ratio equal to 1 between the movement of the intermediate guide part 13 with respect to the fixed guide part 11 and the movement of the movable guide part 12 with respect to the intermediate guide part 13.

Figure 4:
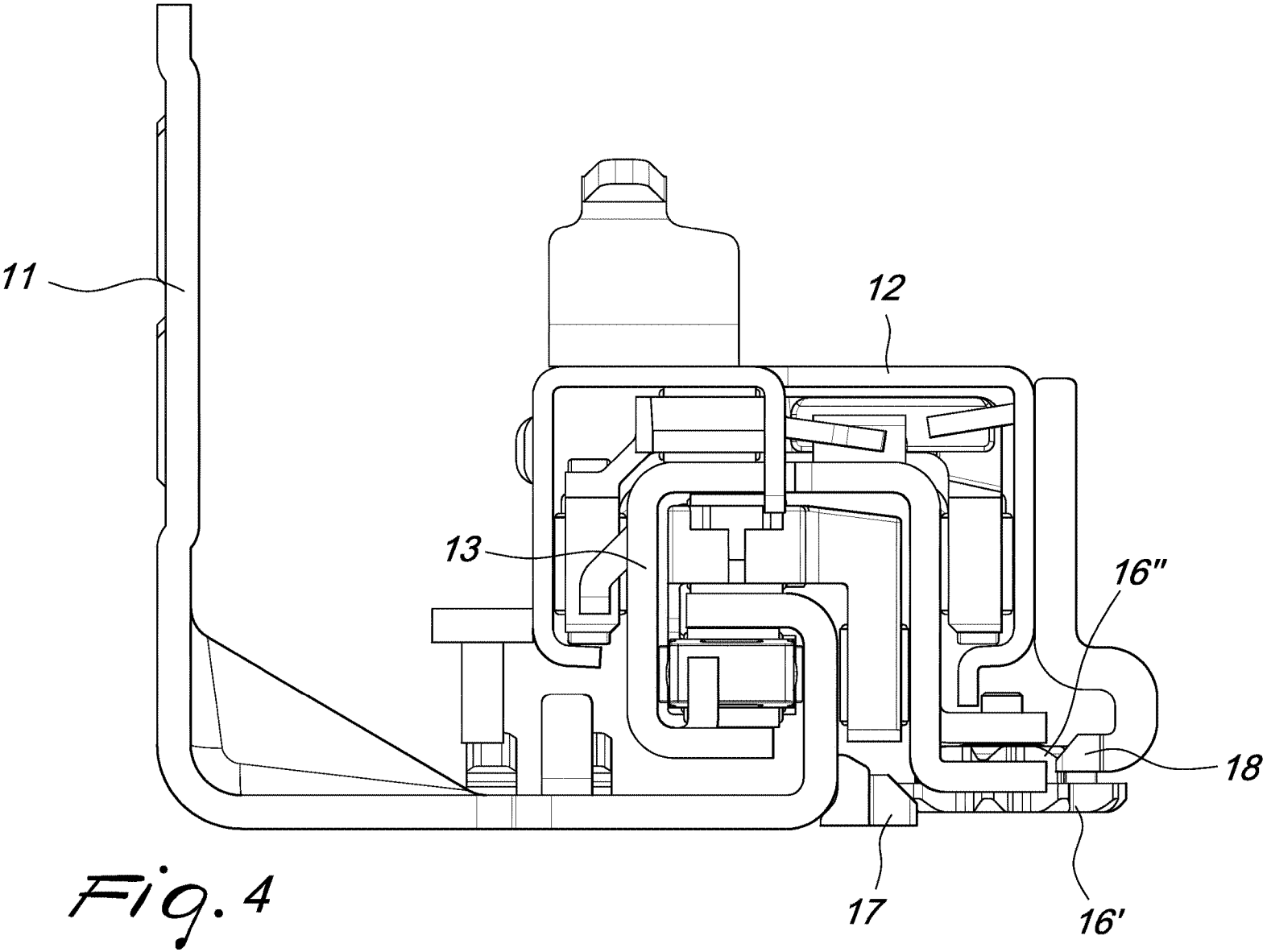
FIG. 4 is a front view of the pull-out guide according to a further variation of the embodiment of FIG. 1.

As an alternative, as shown in FIG. 4, it is also possible to provide at least one first and one second synchronization element 16', 16", which are mutually integrally connected and define a transmission ratio other than 1 between the movement of the intermediate guide part 13 with respect to the fixed guide part 11 and the movement of the movable guide part 12 with respect to the intermediate guide part 13; in this case, the engagement sections 17, 18 must be appropriately offset so that each one engages a respective synchronization element 16', 16".

It is not excluded that the engagement sections might be formed directly on the fixed and movable guide parts 11, 12.

It is not excluded, moreover, that as an alternative to the construction with racks and pinion, the engagement sections might be in the form of engagement and/or rolling surfaces and the synchronization element may be in the form of at least one friction wheel supported rotatably on the intermediate guide part 13 and interposed between said engagement surfaces.

From what has been described above it is evident that the pull-out guide for drawers or the like according to the present invention allows to coordinate safely the guide parts, allowing optimum support and better distribution of the loads on said guide parts.

Furthermore, the pull-out guide according to the invention is provided with motion synchronization means which entail reduced modifications with respect to non-synchronized guides; in particular, the synchronization means comprise only a small number of added components, without the need to provide for appropriate configurations of the sliding carriages.

The guide according to the invention is in any case susceptible of modifications and variations that are within the scope of the appended claims; the constructive details may furthermore be replaced with technically equivalent elements.

The disclosures in Italian Patent Application No. 102017000132137 from which this application claims priority are incorporated herein by reference.

The invention claimed is:

1. A pull-out guide for drawers comprising:

a fixed guide part fastenable to a body of a piece of furniture, a movable guide part fixable to a drawer, an intermediate guide part between said fixed guide part and said movable guide part, at least one first sliding carriage interposed between the fixed guide part and the intermediate guide part, at least one second carriage interposed between the movable guide part and the intermediate guide part, and means of synchronizing the pull-out guide, wherein said means of synchronizing comprise at least one synchronization element arranged on said intermediate guide part and configured to contact both said fixed guide part and said movable guide part, said at least one synchronization element also configured to functionally connect both said fixed guide part and said movable guide part to each other during the pull-out or retraction movement of the pull-out guide, wherein said at least one synchronization element interacts with respective engagement sections on said fixed guide part and said movable guide part, said engagement sections extending opposite to each other at least along a longitudinal portion of said guide parts, in which the movable guide part extends according to a longitudinal axis, wherein the engagement section provided on said movable guide part extends according to an axis that is inclined with respect to the longitudinal axis of the movable guide part in a vertical plane.

2. The pull-out guide according to claim 1, wherein said first sliding carriage is interposed between a bent end section of the fixed guide part and said intermediate guide part and wherein said movable guide part has a partially closed section enclosing and surmounting at least partially said intermediate guide part and said bent section of the fixed guide part.

3. The pull-out guide according to claim 1, wherein said engagement sections are in the form of racks and wherein said synchronization element is in the form of at least one pinion supported so that it can rotate on the intermediate guide part and interposed between said racks.

4. The pull-out guide according to claim 1, wherein said engagement sections are defined on separate support elements applied on the fixed and movable guide parts.

5. The pull-out guide according to claim 4, wherein at least one of said separate support elements has an extension on which the relative engagement section is defined, said extension protruding in such a way that said engagement section is arranged opposite the other engagement section.

6. The pull-out guide according to claim 5, in which the synchronization element is supported so that it can rotate according to an axis, wherein said extension of the separate support element is elastically yielding in a controlled manner in a direction at right angles to said rotational axis of the synchronization element.

7. The pull-out guide according to claim 4, wherein said separate support elements are fixable to the guide parts by way of riveted fastening elements or by way of screwed fixing elements or by way of snap-acting fixing means.

8. The pull-out guide according to claim 1, wherein said engagement sections are in the form of engagement surfaces, rolling surfaces, or engagement surfaces and rolling surfaces, and wherein said synchronization element is in the form of at least one friction wheel supported so that it can rotate on the intermediate guide part and interposed between said engagement and/or rolling surfaces.

9. The pull-out guide according to claim 1, wherein said engagement sections are defined directly on the fixed and movable guide parts.

10. The pull-out guide according to claim 1, in which the movable guide part extends according to a longitudinal axis, wherein the engagement section provided on said movable guide part extends according an axis parallel to the longitudinal axis of the movable guide part.

11. The pull-out guide according to claim 1, further comprising a single synchronization element which defines a transmission ratio of 1 between the displacement of the intermediate guide part with respect to the fixed guide part and the displacement of the movable guide part with respect to the intermediate guide part.

12. A piece of furniture comprising:

at least one pull-out guide; and at least one drawer which can be pulled out with respect to a body of the piece of furniture by way of at least one pull-out guide, wherein the at least one pull-out guide is according to claim 1.

* * * * *